US007290329B2

(12) United States Patent
Magner

(10) Patent No.: US 7,290,329 B2
(45) Date of Patent: Nov. 6, 2007

(54) METHOD AND APPARATUS FOR A SENSOR WIRE

(75) Inventor: Scott Magner, Glastonbury, CT (US)

(73) Assignee: Rockbestos Surprenent Cable Corp., East Granby, CT (US)

( * ) Notice: Subject to any disclaimer, the term of this patent is extended or adjusted under 35 U.S.C. 154(b) by 0 days.

(21) Appl. No.: 11/564,410

(22) Filed: Nov. 29, 2006

(65) Prior Publication Data

US 2007/0095558 A1 May 3, 2007

Related U.S. Application Data

(62) Division of application No. 11/091,259, filed on Mar. 28, 2005.

(51) Int. Cl.
*H01R 43/00* (2006.01)

(52) U.S. Cl. ..... 29/825; 29/868; 156/53; 156/79

(58) Field of Classification Search ..... 29/825, 29/868; 156/53, 79
See application file for complete search history.

(56) References Cited

U.S. PATENT DOCUMENTS

| | | | | |
|---|---|---|---|---|
| 4,269,638 | A * | 5/1981 | Faranetta et al. | 156/53 |
| 4,270,961 | A * | 6/1981 | Faranetta et al. | 156/51 |
| 4,304,713 | A * | 12/1981 | Perelman | 264/45.9 |
| 4,368,350 | A * | 1/1983 | Perelman | 174/102 D |
| 5,926,949 | A * | 7/1999 | Moe et al. | 29/828 |
| 6,326,551 | B1 * | 12/2001 | Adams | 174/113 C |
| 6,997,999 | B2 * | 2/2006 | Houston et al. | 156/51 |
| 7,022,918 | B2 * | 4/2006 | Gialenios et al. | 174/105 R |

* cited by examiner

*Primary Examiner*—Carl J. Arbes
(74) *Attorney, Agent, or Firm*—Hayes Soloway PC

(57) ABSTRACT

A cable includes a conductor having an insulation layer wrapped substantially about the conductor. A foamable polymer layer is applied substantially about the insulation layer. A cross-section of the foamable polymer layer has a substantially uneven outer surface. An armor shell is applied exterior to the foamable polymer layer. The armor shell is substantially concentric to the conductor.

14 Claims, 6 Drawing Sheets

METHOD AND APPARATUS FOR A SENSOR WIRE

CROSS REFERENCE TO RELATED APPLICATION

This application is a divisional application of pending U.S. application Ser. No. 11/091,259 filed Mar. 28, 2005.

FIELD OF THE INVENTION

The present invention relates to methods and apparatus for making insulated wires and more particularly to methods and apparatus for making insulated wires usable in onshore and offshore oil exploration sites.

BACKGROUND OF THE INVENTION

One type of cable that is used in onshore and offshore oil exploration sites is a foamed polymer cable. FIG. 1 is a cross-sectional view of one type of foamable polymer cable 10 in the prior art. At an axial center of the foamed foamable polymer cable 10 is a conductor 12, such as a seven strand, eighteen gauge, copper conductor. Enveloping the conductor 12 is a fluoropolymer film 14, such as TEFZEL®, the fluoropolymer film is sold by DUPONT FILMS®. Beyond the fluoropolymer film 14 is a polymer layer 16. A pneumatic void 18 surrounds the polymer layer 16 in the foamable polymer cable 10. Defining an outer limit of the pneumatic void 18 is an armor shell 20. The pneumatic void 18 is a temporary feature of the foamable polymer cable 10.

The foamable polymer cable 10 design, for instance, may use polymer layer 16 with an outside diameter of 0.165 inches and an armor shell 20 having an inside diameter of 0.194 inches, wherein the space between defines the pneumatic void 18. The pneumatic void 18 allows the armor shell 20 to be pressure tested, such as with a hydrostatic pressure test, to check the weld integrity of the armor shell 20. Once the pressure test is completed, the polymer layer 16 is induced to foam, substantially filling the pneumatic void 18. Foaming a polymer, such as polyethylene or polypropylene is a precise science in that an above-ambient temperature is introduced to the polymer layer 16. The required foaming temperature is often greater than the melting point of the fluoropolymer film 14, which may cause a dielectric failure if the process is not properly controlled. The thermal elongations of the materials that are heated are not consistent either.

One flaw with the foamable polymer cable 10 design is that the cross-sectional pneumatic void 18 is so large that foaming the foamable polymer cable 10 regularly yields an exocentric cable. The concentricity of the conductor 12 relative to the armor shell 20 is necessary to insure a consistent capacitance throughout the foamable polymer cable 10. Capacitance is of critical importance in manufactured cables in excess of 10,000 feet, such as those cables used in oil exploration. Therefore, the pneumatic void 18, which is necessary for allowing pressure testing of the armor shell 20, inhibits production of a concentric cable.

Thus, a heretofore unaddressed need exists in the industry to address the aforementioned deficiencies and inadequacies.

SUMMARY OF THE INVENTION

Embodiments of the present invention provide a system and method for making a foamable polymer cable.

Briefly described, in architecture, one embodiment of the system, among others, can be implemented as follows. A cable includes a conductor having an insulation layer wrapped substantially about the conductor. A foamable polymer layer is applied substantially about the insulation layer. A cross-section of the foamable polymer layer has a substantially uneven outer surface. An armor shell is applied exterior to the foamable polymer layer. The armor shell is substantially concentric to the conductor.

The present invention also includes a method for making a foamable polymer cable. The method includes: wrapping an insulation layer substantially about a conductor; applying a foamable polymer layer substantially about the insulation layer, wherein a cross-section of the foamable polymer layer has a substantially uneven outer surface; and welding an armor shell exterior to the foamable polymer layer, wherein the armor shell is substantially concentric to the conductor.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
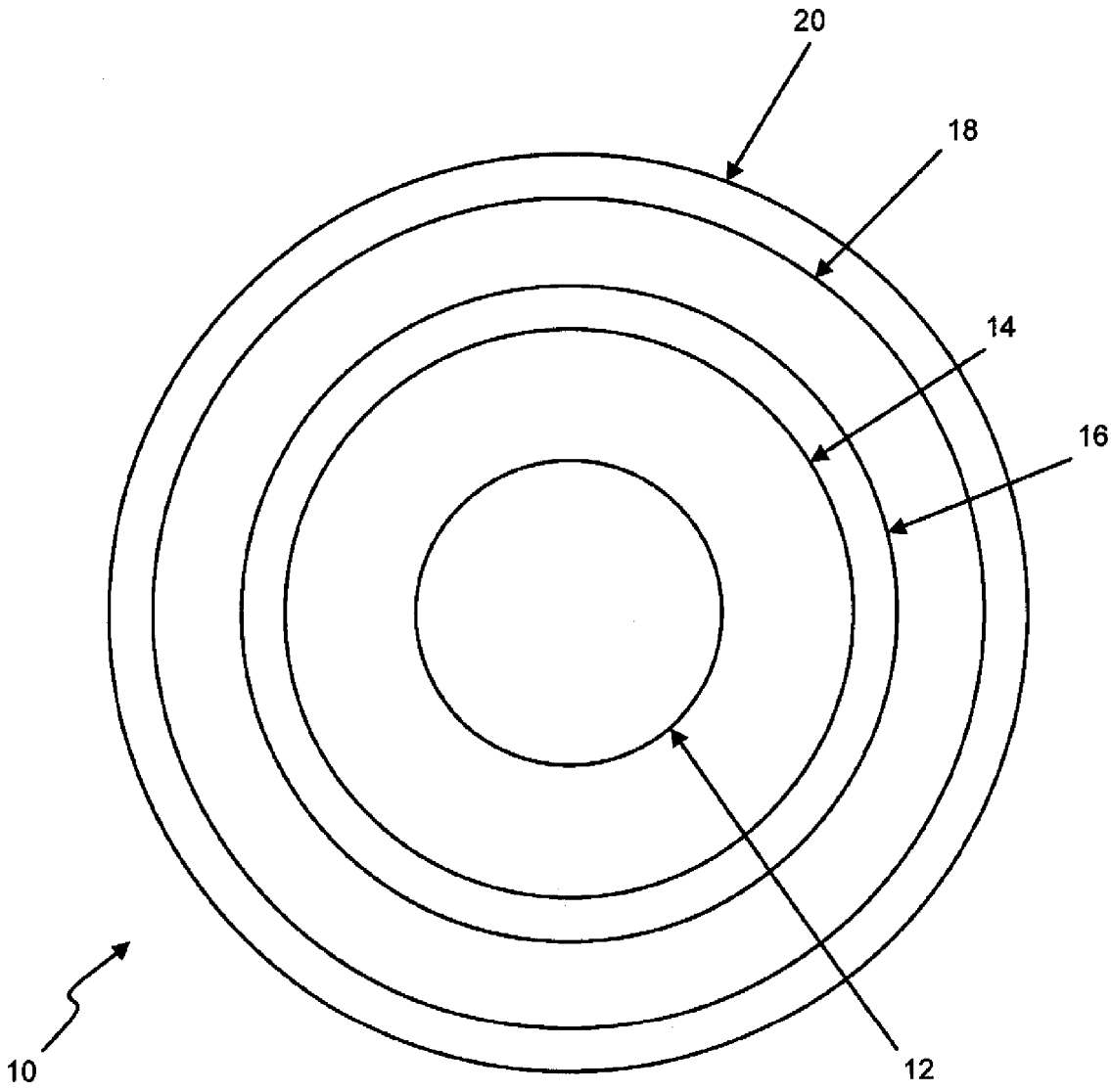
FIG. 1 (PRIOR ART)
FIG. 1 is a cross-sectional view of one type of foamable polymer cable in the prior art.
Figure 2:
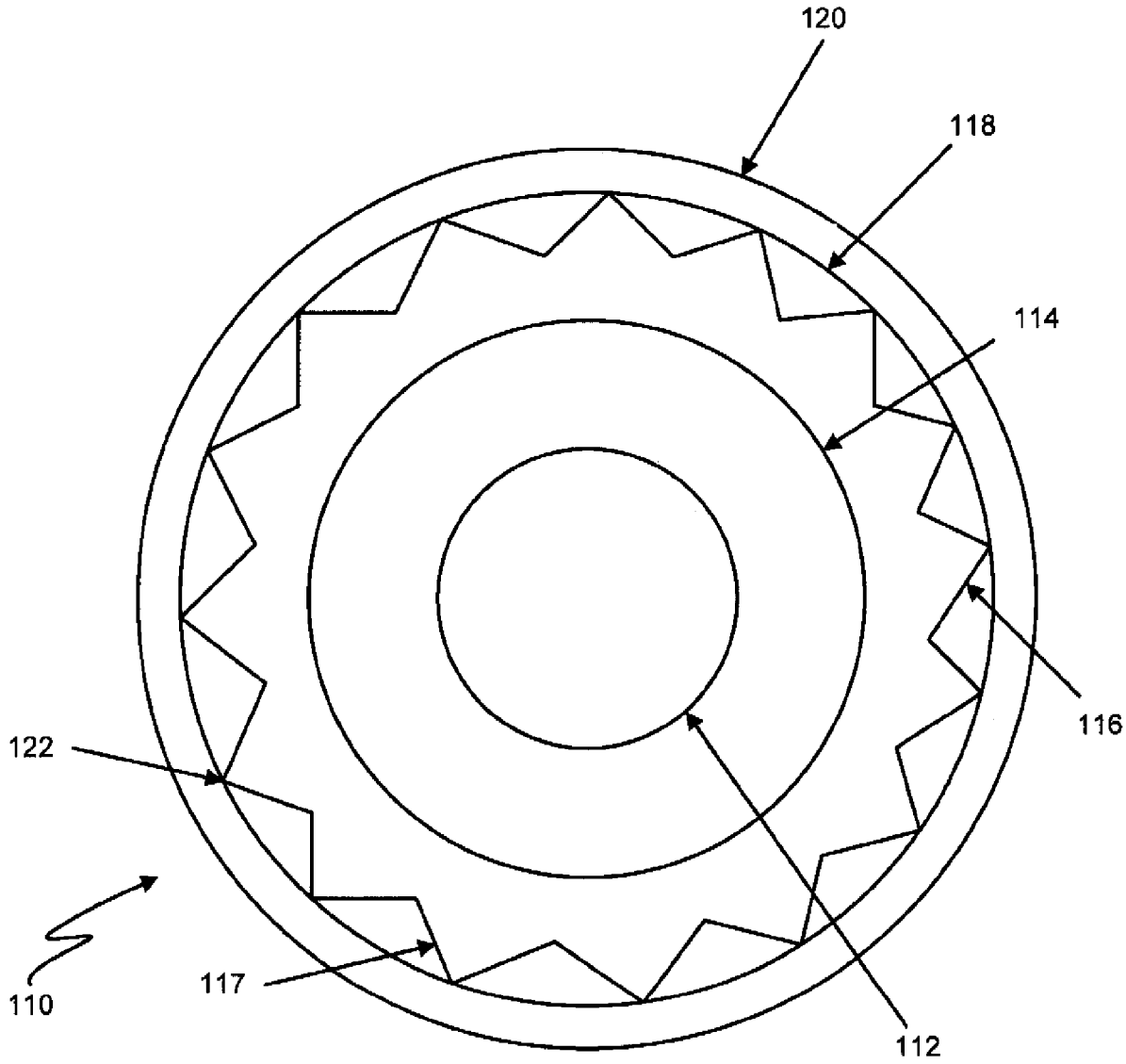
FIG. 2 is a cross-sectional view of a foamable polymer cable, in accordance with a first embodiment of the invention.

FIG. 2 is a cross-sectional view of a foamable polymer cable 110, in accordance with a first embodiment of the invention. The formable polymer cable 110 includes a conductor 112 having an insulation layer 114 wrapped substantially about the conductor 112. A foamable polymer layer 116 is applied substantially about the insulation layer 114. A cross-section of the foamable polymer layer 116 has a substantially uneven outer surface 117. An armor shell 120 is applied exterior to the foamable polymer layer 116. The armor shell 120 is substantially concentric to the conductor 112.

Figure 3:
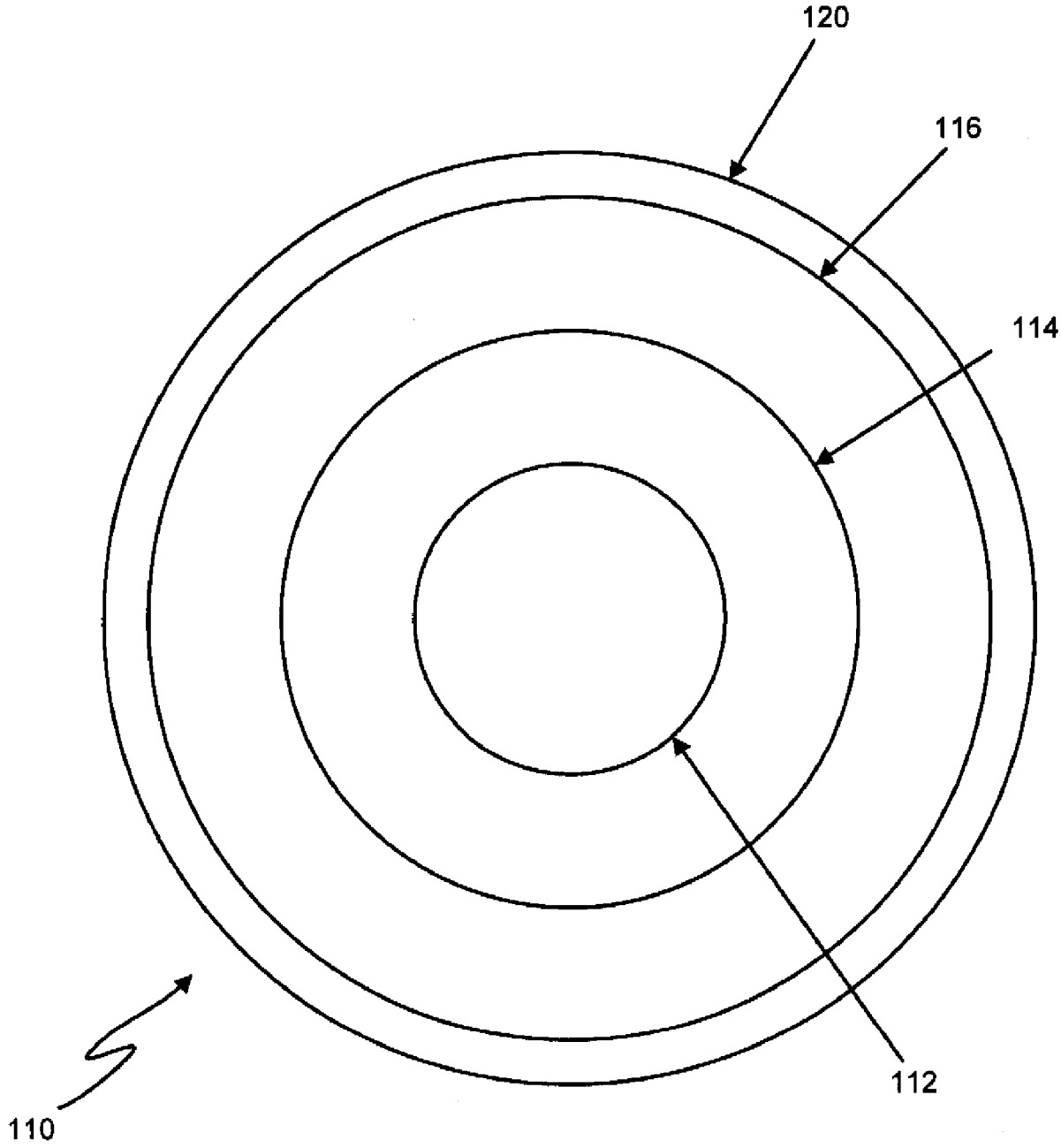
FIG. 3 is a cross-sectional view of the foamable polymer cable of FIG. 2, after foaming, in accordance with the first embodiment of the invention.

The substantially uneven outer surface 117 of the foamable polymer layer 116 works to create a plurality of pneumatic voids 118 between the foamable polymer layer 116 and the armor shell 120. The pneumatic void 118 allows the armor shell 120 to be pressure tested, such as with a hydrostatic pressure test, to verify the weld integrity of the armor shell 120. Once the pressure test is completed, the foamable polymer layer 116 may be induced to foam, substantially filling the plurality of pneumatic void 118. FIG. 3 is a cross-sectional view of the foamable polymer cable 110 of FIG. 2, after foaming, in accordance with the first embodiment of the invention. By designing the foamable polymer layer 116 to be in contact with the armor shell 120 before and after foaming, the foamable polymer layer 116 can be shaped to hold the armor shell 120 in a position substantially concentric to the conductor 112.

The foamable polymer layer 116, for instance may be polypropylene or polyethylene, or another type of foamable polymer layer 116 that is capable of behaving similarly to the foamable polymer layer 116 disclosed herein. Specifically, the foamable polymer layer 116 should be capable of being shaped and be within the armor shell 120 before foaming. Many foamable polymers are not designed for this usage. The foamable polymer layer 116, for instance, may go through an extrusion process and, thereafter, be made to foam, whereas many foamable polymers cannot foam after the extrusion process.

As shown in FIG. 2, the pre-foam design of the foamable polymer layer 116 of the foamable polymer cable 110 may include a series of striation points 122 as part of the substantially uneven surface 117. FIG. 2 illustrates that, in the first embodiment, one foamable polymer cable 110 may have nineteen striation points 122. In alternate striation designs, the foamable polymer layer 116 may have anywhere from two striation points to about 30 striation points. In this embodiment, the striation points 122 have approximately the same radial height as half an inner diameter of the armor shell 120. There may be at least approximately 0.001 inches between the striation points 122 and the armor shell 120, which may be necessary for pressure testing.

As shown in FIG. 2, the pneumatic voids 118 may be substantially triangular in shape. The pneumatic voids 118 may also assume rectangular, trapezoidal, or other shapes. A shape of the pneumatic void 118 will be determined by the substantially uneven surface 117 and the armor shell 120, which together form the pneumatic voids 118. A single foamable polymer cable may also have disparately shaped pneumatic voids 118. Those having ordinary skill in the art will recognize the many permutations of shapes available for both the pneumatic voids 118 and the foamable polymer layer 116, which are all considered to be within the scope of this invention.

Figure 4:
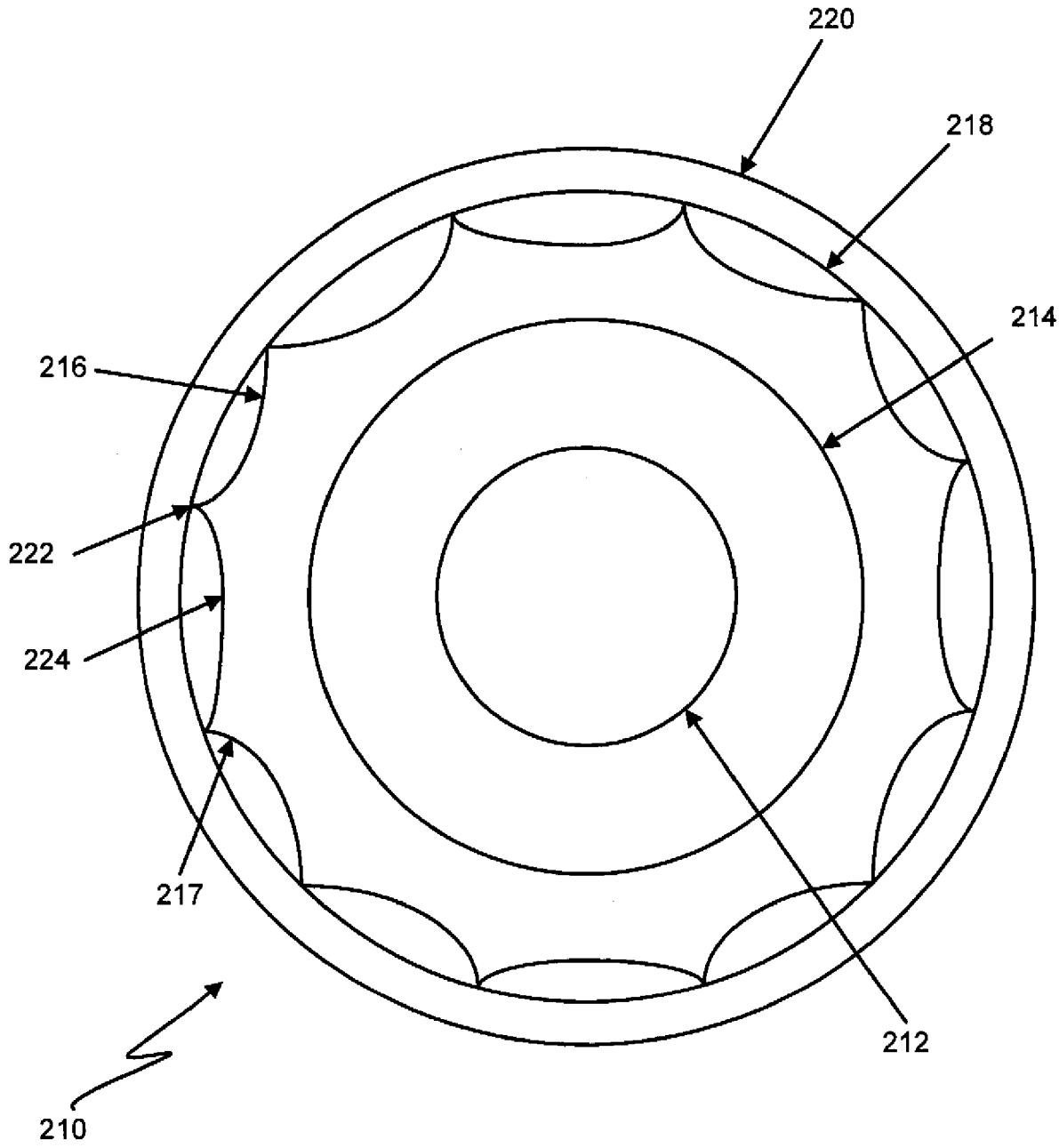
FIG. 4 is a cross-sectional view of a foamable polymer cable, in accordance with a second embodiment of the invention.

FIG. 4 is a cross-sectional view of a foamable polymer cable 210, in accordance with a second embodiment of the invention. The foamable polymer cable 210 includes a conductor 212 having an insulation layer 214 wrapped substantially about the conductor 212. A foamable polymer layer 216 is applied substantially about the insulation layer 214. A cross-section of the foamable polymer layer 216 has a substantially uneven outer surface 217. An armor shell 220 is applied exterior to the foamable polymer layer 216. The armor shell 220 is substantially concentric to the conductor 212.

The substantially uneven outer surface 217 of the foamable polymer layer 216 works to create a plurality of pneumatic voids 218 between the foamable polymer layer 216 and the armor shell 220. The substantially uneven outer surface 217 may include a plurality of radial peaks 222 and radial valleys 224. In this embodiment, the radial peaks 222 have approximately the same radial height as half an inner diameter of the armor shell 220. The radial height of the radial peaks 222, for instance, may be 0.01 inches greater than the radial height of the radial valleys 224. In another design, the radial peaks 222 may be up to 0.001 inches away from the armor shell 220, while the radial valleys 224 are approximately 0.020 inches from the armor shell 220. In the second exemplary embodiment, the armor shell 220 may have an outer diameter of approximately 0.25 inches and a thickness of between 0.025 inches and 0.040 inches.

Figure 5:
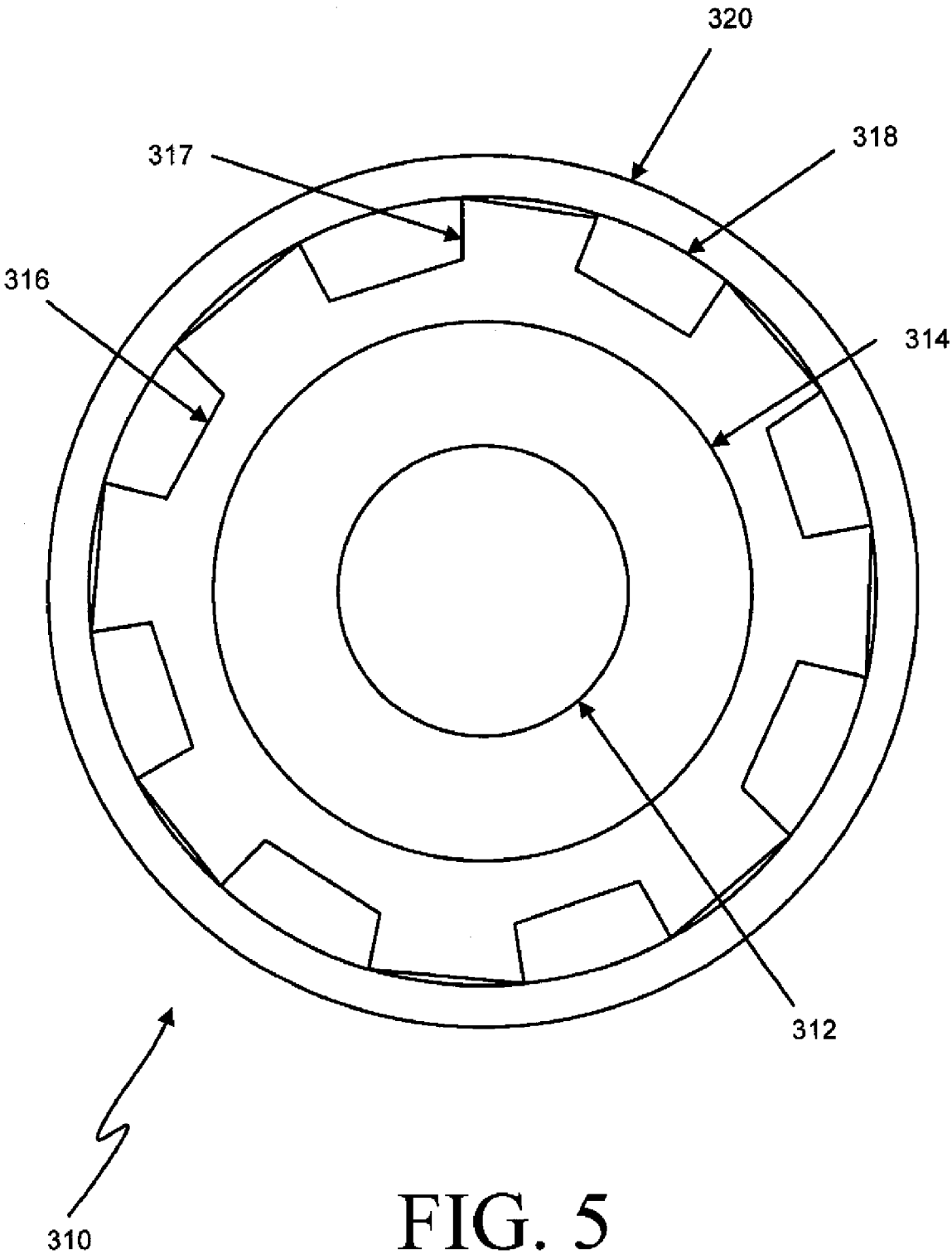
FIG. 5 is a cross-sectional view of a foamable polymer cable, in accordance with a third embodiment of the invention.

FIG. 5 is a cross-sectional view of a foamable polymer cable 310, in accordance with a third embodiment of the invention. The foamable polymer cable 310 includes a conductor 312 having an insulation layer 314 wrapped substantially about the conductor 312. A foamable polymer layer 316 is applied substantially about the insulation layer 314. A cross-section of the foamable polymer layer 316 has a substantially uneven outer surface 317. An armor shell 320 is applied exterior to the foamable polymer layer 316. The armor shell 320 is substantially concentric to the conductor 312.

The substantially uneven outer surface 317 of the foamable polymer layer 316 creates a plurality of pneumatic voids 318 between the foamable polymer layer 316 and the armor shell 320. The substantially uneven outer surface 317 may include a substantially undulated outer surface, shown in FIG. 5. The undulated outer surface may take the form of square waves or waves of other shapes.

Figure 6:
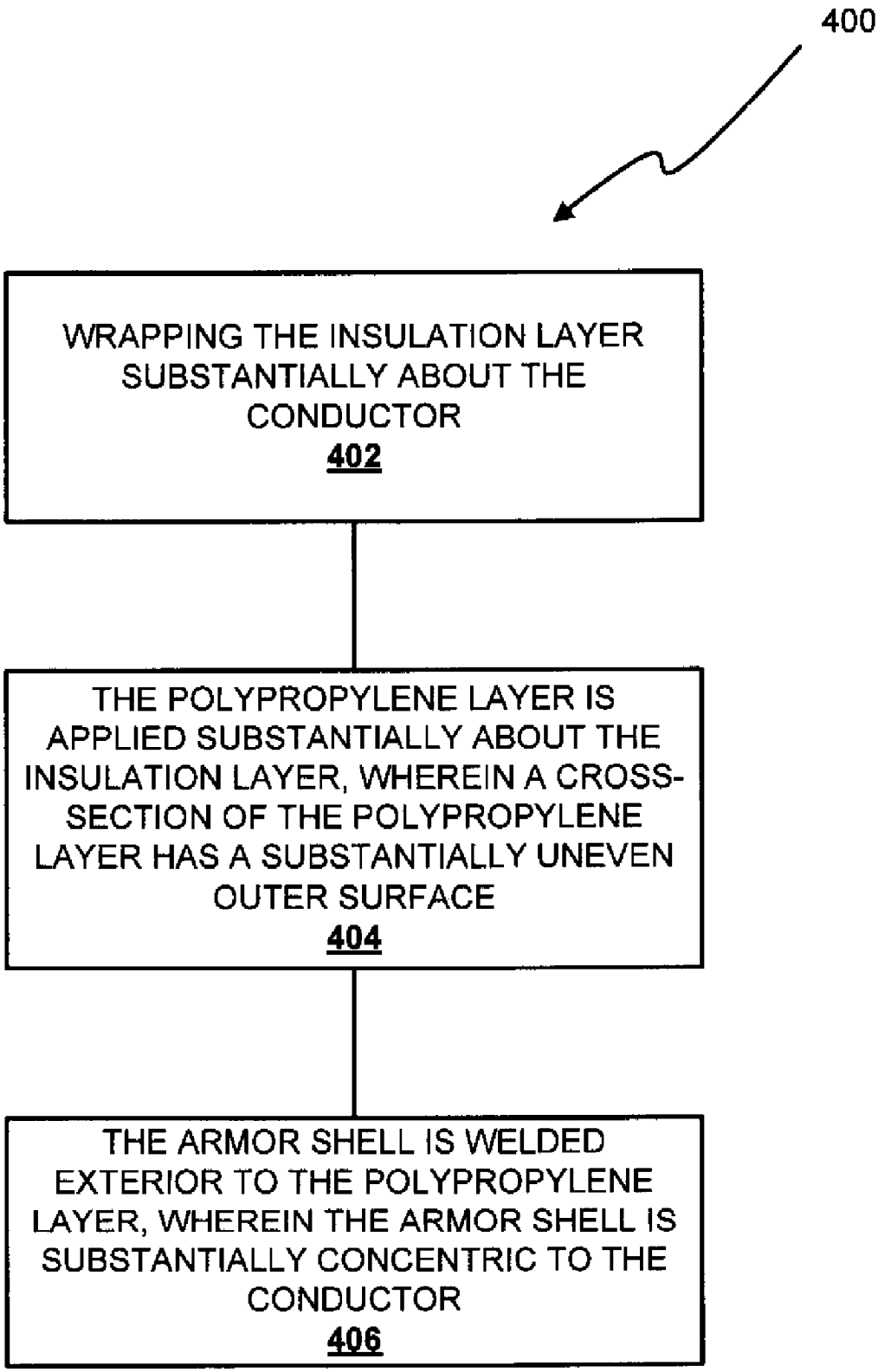
FIG. 6 is a flow chart illustrating one possible method of manufacturing the foamable polymer cable of FIG. 2, in accordance with the first embodiment of the invention.

The flow chart of FIG. 6 illustrates one possible method of manufacturing the foamable polymer cable 110 of FIG. 2, in accordance with the first embodiment of the invention. In this regard, each block represents a module, segment, or step, which comprises one or more instructions for implementing the specified function. It should also be noted that in some alternative implementations, the functions noted in the blocks might occur out of the order noted in FIG. 6. For example, two blocks shown in succession in FIG. 6 may in fact be executed substantially concurrently or the blocks may sometimes be executed in the reverse order, depending upon the functionality involved, as will be further clarified herein.

As shown in FIG. 6, the method 400 of making the foamable polymer cable 110 includes wrapping the insulation layer 114 substantially about the conductor 112 (block 402). The foamable polymer layer 116 is applied substantially about the insulation layer 114, wherein a cross-section of the foamable polymer layer 116 has a substantially uneven outer surface 117 (block 404). The armor shell 120 is welded exterior to the foamable polymer layer 116, wherein the armor shell 120 is substantially concentric to the conductor 112 (block 406). This process may leave a plurality of pneumatic voids 118 between the foamable polymer layer 116 and the armor shell 120.

The method 400 of making the foamable polymer cable 110 may further include testing a weld integrity of the armor shell 120. Testing the weld integrity of the armor shell 120 may be accomplished with a pressure test, such as a hydrostatic pressure test. After the hydrostatic pressure test, the foamable polymer layer 116 may be foamed to substantially fill the pneumatic voids 118.

Foaming the foamable polymer cable 110 may be important for some applications. It is desirable to have at least two pounds of pullout force in a foamable polymer cable. Pullout force is defined as the amount of force to pull a twelve-inch long core (conductor plus insulation layer) from a ten-inch long armor shell. Having less than two pounds of pullout force may be detrimental to the integrity of the foamable polymer cable. Specifically, when using a foamable polymer cable that is tens of thousands of feet, which is not unusual in the oil exploration industry, the weight of the conductor may exceed its tensile strength. Therefore, the conductor may snap or otherwise suffer integrity damage if unsupported along its length. Having at least two pounds of pullout force implies that the armor shell and foamable polymer layer will work to support the conductor. Foaming the foamable polymer layer may be necessary to attain at least two pounds of pullout force in the foamable polymer cable.

The step of applying the foamable polymer layer 116 (block 404) may involve applying the foamable polymer layer 116 substantially about the insulation layer 114 and extruding the foamable polymer layer 116, wherein the cross-section of the foamable polymer layer 116 is made to have a substantially uneven outer surface 117. Those having ordinary skill in the art, particularly in the art of extrusion, will appreciate how the foamable polymer layer 116 may be extruded to create a substantially uneven outer surface 117.

Extruding the foamable polymer layer 116 may involve striating the foamable polymer layer 116. The foamable polymer layer 116 may be striated to create between two and approximately thirty striations in the foamable polymer layer 116. Nineteen striations, in particular, have proven to be effective in securing sufficient spacing for pneumatic voids 118, while maintaining the concentricity of the armor shell 120 relative to the conductor 112 before and during foaming.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of making a cable, the method comprising the steps of:

wrapping an insulation layer substantially about a conductor;

applying a foamable polymer layer substantially about the insulation layer, wherein a cross-section of the foamable polymer layer has a substantially uneven outer surface;

welding an armor shell, wherein the armor shell is exterior to the foamable polymer layer, wherein the armor shell is substantially concentric to the conductor; and leaving at least one contiguous pneumatic void along a length of the cable between the substantially uneven outer surface of the foamable polymer layer and the armor shell.

2. The method of claim 1, further comprising:

testing a weld integrity of the armor shell; and foaming the foamable polymer layer.

3. The method of claim 2, wherein the step of testing the weld integrity further comprises performing a hydrostatic pressure test of the weld integrity of the armor shell.

4. The method of claim 1, wherein the step of applying the foamable polymer layer further comprises:

applying the foamable polymer layer substantially about the insulation layer, wherein the cross-section of the foamable polymer layer has a substantially even outer surface; and extruding the foamable polymer layer, wherein the cross-section of the foamable polymer layer has the substantially uneven outer surface.

5. The method of claim 4, wherein the step of extruding the foamable polymer layer, further comprises striating the foamable polymer layer.

6. The method of claim 5, wherein the step of striating the foamable polymer layer further comprises creating between 2 and approximately 30 striations in the foamable polymer layer.

7. The method of claim 1, further comprises the step of forming a plurality of pneumatic voids between the armor shell and the foamable polymer layer along the length of the cable.

8. A method of making a cable, the method comprising the steps of:

applying a fluoropolymer insulation layer substantially about a conductor;

extruding a foamable polymer layer substantially about the fluoropolymer insulation layer, wherein a cross-section of the foamable polymer layer has a substantially uneven outer surface; and longitudinally welding an armor shell that is exterior to the foamable polymer layer, wherein the armor shell is substantially concentric to the conductor.

9. The method of claim 8, further comprising:

testing the weld integrity of the armor shell, wherein the step of testing includes at least one of an inert gas pressure test and a hydrostatic test; and foaming the foamable polymer layer, thereby expanding the foamable polymer layer and filling at least one pneumatic void, whereby the foamable polymer layer becomes a foamed polymer layer.

10. The method of claim 8, wherein the step of extruding the foamable polymer layer further comprises:

extruding the foamable polymer layer substantially about the insulation layer without activating the foamable polymer layer, wherein the cross-section of the foamable polymer layer has a substantially even outer surface.

11. The method of claim 10, further comprising extruding a plurality of peaks and a plurality of valleys into the foamable polymer layer, thereby creating a plurality of contiguous pneumatic voids between the foamable polymer layer and the armor shell along a length of the cable.

12. The method of claim 10, wherein the step of extruding the foamable polymer layer, further comprises striating the foamable polymer layer.

13. The method of claim 12, wherein the step of striating the foamable polymer layer further comprises extruding between 2 and approximately 30 striations in the foamable polymer layer, thereby leaving a plurality of pneumatic voids between the armor shell and the foamable polymer layer along the length of the cable.

14. The method of claim 8, further comprises the step of forming a plurality of pneumatic voids between the armor shell and the foamable polymer layer.

* * * * *